United States Patent [19]

Okamura

[11] Patent Number: 4,511,780

[45] Date of Patent: Apr. 16, 1985

[54] DOOR LATCH ASSEMBLY FOR MICROWAVE HEATING APPARATUS

[75] Inventor: Yoshio Okamura, Nagoya, Japan

[73] Assignee: Tokyo Shibaura Denki Kabushiki Kaisha, Kawasaki, Japan

[21] Appl. No.: 554,809

[22] Filed: Nov. 23, 1983

[30] Foreign Application Priority Data

Jan. 14, 1983 [JP] Japan ..... 58-4629

[51] Int. Cl.[3] ..... H05B 6/76

[52] U.S. Cl. ..... 219/10.55 C; 219/10.55 D; 200/50 C; 126/197

[58] Field of Search ..... 219/10.55 C, 10.55 D, 219/10.55 B, 10.55 R; 200/50 A, 50 C, 61.62, 61.64, 61.68, 61.76, 61.79, 61.83; 126/197

[56] References Cited

U.S. PATENT DOCUMENTS

| | | | |
|---|---|---|---|
| 3,496,316 | 2/1970 | Foerstner | 200/50 A |
| 3,715,552 | 2/1973 | Umezu et al. | 219/10.55 C |
| 3,715,554 | 2/1973 | Umezu | 219/10.55 C |
| 3,733,456 | 5/1973 | Blackburn | 219/10.55 C |
| 3,777,098 | 12/1973 | Tapper | 219/10.55 C |
| 3,800,108 | 3/1974 | Inagawa | 200/61.62 |
| 3,803,725 | 4/1974 | Takeyama | 200/61.62 X |
| 3,967,088 | 6/1976 | Horiuchi | 219/10.55 C |

FOREIGN PATENT DOCUMENTS

| | | |
|---|---|---|
| 54-1056 | 1/1979 | Japan . |
| 54-38307 | 11/1979 | Japan . |
| 55-23801 | 2/1980 | Japan . |

*Primary Examiner*—Philip H. Leung

*Attorney, Agent, or Firm*—Schwartz, Jeffery, Schwaab, Mack, Blumenthal & Koch

[57] ABSTRACT

A switch operating assembly for a microwave heating apparatus having a locking mechanism. The locking mechanism includes a sliding member which moves to turn on a switch when a cooking start button is pushed, and which slides automatically to turn off the switch when the door is opened. The locking mechanism also includes a guide member having a pair of inclined slits for guiding the sliding member.

6 Claims, 8 Drawing Figures

DOOR LATCH ASSEMBLY FOR MICROWAVE HEATING APPARATUS

BACKGROUND OF THE INVENTION

This invention relates generally to doors for microwave cooking ovens and more particularly to a latch assembly for a microwave heating apparatus.

In a conventional microwave heating apparatus, such as a microwave oven, a microwave frequency of about 2450 MHz is used to cook various food products. In such microwave ovens, if the cabinet door does not completely close, microwaves leak outside of the oven through a narrow air gap around the periphery of the door. The leakage of the microwave adversely affects nearby electric devices, such as a television receiver, and is also harmful to nearby persons.

Accordingly, it is desirable not only to completely close the door during cooking operations but also to deenergize the microwave generator when the door is opened. To accomplish this function, various kinds of door latches are well known as shown, for example, in U.S. Pat. Nos. 3,715,552 and 3,777,098.

However, since the magnetron is re-energized if the door is closed and then opened within the cooking operating time, there is a danger of operating the oven without the food products therein if these food products are removed before the door is again closed.

Accordingly, the microwave oven is usually designed as shown in Japanese published Utility Model No. 54-1056 and No. 54-38307 published respectively on Jan. 19, and Nov. 14, 1979. Namely, the microwave oven has a mechanical locking assembly which operates such that the magnetron is not energized unless the cook starting button is operated when the door is in its closed position. The conventional door latch assembly is very complicated because it has springs to operate the switch assembly disposed in the generating circuit. These springs must be carefully selected to achieve the desired switching action and they deteriorate with use thus making it difficult to obtain consistent, long-term durability. It is also difficult to manufacture the door latch assembly because of the many parts thereof.

SUMMARY OF THE INVENTION

It is accordingly an object of the invention to provide an improved door latch assembly for a microwave heating apparatus.

It is another object of the invention to provide a novel door latch assembly which is simple in construction.

It is a further object of the invention to provide a novel sliding member which turns off the microwave generator switch automatically in the opened door position.

To accomplish the foregoing and other objects in accordance with a preferred embodiment of the present invention, there is provided a door latch assembly for a microwave heating apparatus which has a pivoting lever connected to the door, a locking mechanism cooperating with the lever for locking the door in the closed position, a switch coupled to the microwave generator, and a sliding member mounted on the locking mechanism for operating the switch by the pivoting lever. The sliding member turns off the switch automatically in the opened position.

BRIEF DESCRIPTION OF THE INVENTION

The invention may be understood in reference to the drawings, forming a part hereof, in which like reference characters denote like parts in the various views wherein.

DESCRIPTION OF THE PREFERRED EMBODIMENTS

Figure 1:
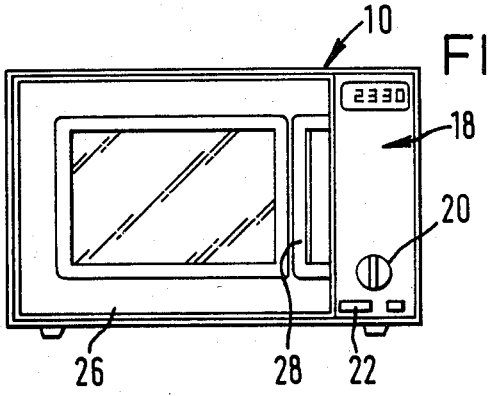
FIG. 1 is a front view of a microwave heating apparatus of the invention.
Figure 2:
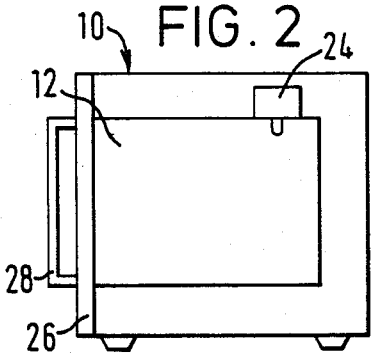
FIG. 2 is a side view of a microwave heating apparatus of the invention.
Figure 3:
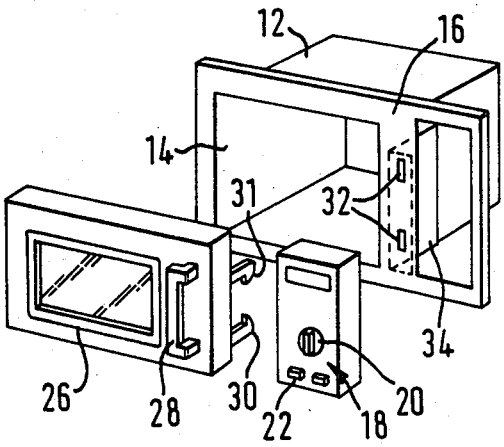
FIG. 3 is an exploded perspective view of a microwave heating apparatus of the invention.

Referring to the drawings, there is shown a microwave cooking oven comprising a metal cabinet 10 having a heating chamber 12 formed therein.

The heating chamber 12 has an access opening 14 at one side for loading and unloading food products to be cooked.

The heating chamber 12 opens into a front panel 16 which also includes the control panel 18. The control panel 18 has a timer dial 20 and a cooking start button 22. Other control switches can also be mounted on the front panel 16.

On the top wall of the heating chamber 12 is mounted a microwave generator 24, such as a magnetron oscillator, which radiates microwave energy to the heating chamber 12. To close the access opening of the cabinet, a door 26 is pivotally hinged at one side edge of the access opening 14.

An operating handle 28 is provided on the other side portion of the outer surface of door 26 and levers 30, 31 are pivotally connected at one end thereof to the door 26 and extend into the front panel 16 at the other end thereof through apertures 32 on the front panel 16.

The pivoting levers 30, 31 are biased by springs 58 and have a hook 33 at the other end thereof. A locking mechanism 34 is fixedly secured to the inner wall of the front panel 16 adjacent one of the apertures 32 for locking the door to the cabinet when the door is closed.

Figure 4:
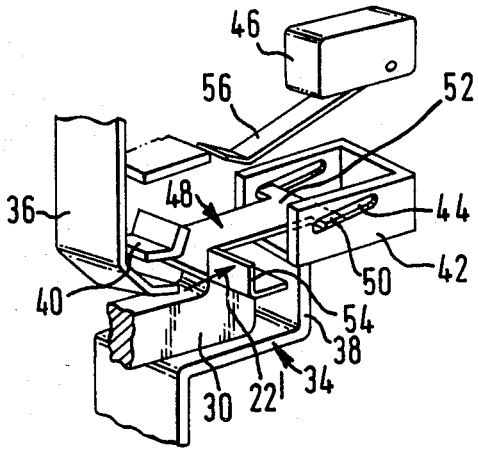
FIG. 4 is a perspective view of a door latch assembly of the invention.

More particularly, such as shown in FIG. 4, the locking mechanism 34 comprises a locking member 36 for engaging the hook 33 of the lever 30, a holding member 38 for forming a space adjacent the aperture 32 to receive the hook 33 in the closed position, a stopper 40 formed near the locking member 36, and a guide member 42 formed on the upper portion of the holding member 38. The guide member 42 has a pair of inclined slits 44.

There is also provided a micro-switch 46 for controlling the operation of magnetron 24. The switch 46 is actuated in response to the movement of a sliding member 48.

Figure 5:
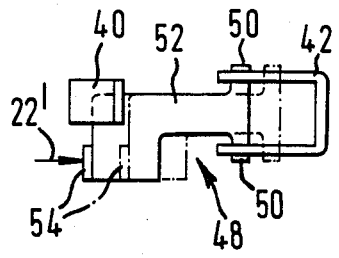
FIG. 5 is a top view of a sliding member of the invention.

As shown in FIG. 5, the sliding member 48 has a pair of tabs 50, a base portion 52 and a standing portion 54. Tabs 50 are slidably inserted in the slits 44.

The base portion 52 is positioned between the hook 33 and an actuator 56 of the switch 46 so as to cause actuator 56 to press against a contact 57 to turn on switch 46 in response to movement of hook 33.

Figure 6:
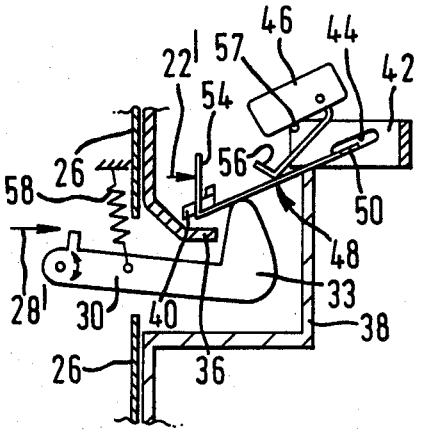
FIGS. 6, 7 and 8 are respectively cross-sectional views of a door latch assembly of the invention in different operating positions, namely: a closed position of the door prior to actuation of a cooking start button; a closed position of the door after actuation of the cooking start button; and an opened position of the door.

A part of the base portion 52 contacts the stopper 40 in the door closed position when the cooking start button 22 is not operated (FIG. 6).

The standing portion 54 is formed by folding an end of base portion 52. The standing portion 54 is positioned adjacent the cooking start button 22 and is moved in response to actuation of the cooking start button 22.

The lever 31 is engaged with another simple locking member secured to the inner wall adjacent the other aperture 32. This other locking mechanism may be identical to the one previously described with the switch itself controlling another microwave oven circuit function.

Figure 7:
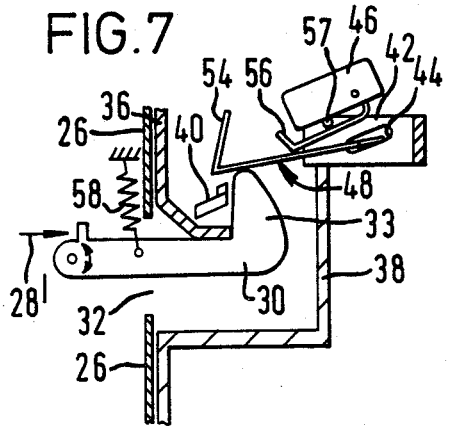
Figure 8:
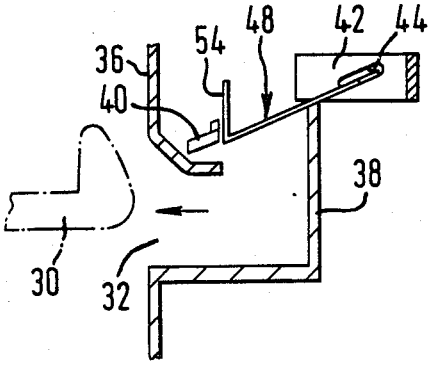

The operation of the door latch assembly in accordance with the present invention will be described hereinbelow with reference to FIGS. 6–8.

After food products are placed in the heating chamber 12, the door 26 is closed. During closing of the door, the levers 30, 31 enter the apertures 32, and the door is locked by the locking mechanism 34 so that the hook 33 is biased toward engagement with the locking member 36 by action of spring 58. When the door is fully closed, hook 33 presses up against the sliding member 48 as shown in FIG. 6. However, since a part of the base portion 52 is held by the stopper 40, sliding member 48 is prevented from moving upwardly. In this situation, the switch 46 is not yet actuated and remains OFF.

The timer dial 20 is set to a desired cooking time and then the cooking start button 22 is pushed and cooking starts. The cooking start button 22 is operable upon depression thereof to bear against standing portion 54 as shown by 22' in FIG. 6. Upon actuation of the cooking start button 22, the standing portion 54 is forced to move to the right as viewed in FIG. 6. Accordingly, as the sliding member 48 slides to the right within slit 44, a part of the base portion 52 is released from the stopper 40 and the hook 33 urges the base portion 52 to move upwardly so that the actuator 56 depresses the contact 57 thereby turning on switch 46 as shown in FIG. 7.

In this manner, the magnetron 24 begins to oscillate and supplies microwave radiation in the heating chamber 12 to heat the food products contained therein. After a lapse of a predetermined cooking time set by the timer 20, the magnetron 24 is deenergized.

To open the door 26, the lever 30 of the operating levers 30 and 31 are depressed downwardly (via handle 28 and conventional linkage mechanism, indicated by arrow 28') against the action of spring 58. Since the sliding member 48 is now free, it slides downwardly along the inclined slit 44 to return to its initial position, and the base portion 52 becomes once again engaged with the stopper 40. The downward movement of sliding member 48 is also assisted by the urging of actuator 56 which is spring biased to the open position thereof. When actuator 56 opens, contact 57 is released thus turning off switch 46. Subsequently, the levers 30, 31 are released from the locking member 36, and the door is opened. The cooking start button returns to its initial position after it is released. Accordingly, it is possible to take out the cooked food products from the heating chamber.

In opening the door 26 during the cooking operation, the sliding member 48 slides automatically as in the above description, and the switch turns off to deenergize the magnetron. Since the lever 30 is pivoted prior to opening the door, the magnetron will turn off prior to the actual door opening.

While the invention has been described in reference to a preferred embodiment, it will be understood by those skilled in the art that various modifications may be made without departing from the spirit and scope of the invention as set forth in the appended claims.

What is claimed is:

1. A microwave heating apparatus including a cabinet for defining a heating chamber having an access opening at one side thereof, a door mounted on said cabinet for closing said access opening, a cooking start button and a microwave generator for radiating microwave energy into said heating chamber, said apparatus comprising:

a front panel formed in said cabinet for contacting with said door and having an aperture therein;

a lever pivotally connected to said door at one end thereof and provided at the other end with a hook for insertion into said aperture;

a locking mechanism for locking said door in the closed position, said locking mechanism comprises a locking member secured to said cabinet to cooperate with said hook, and a holding member for forming a space adjacent said aperture to receive said hook in the closed position of said door;

a switch coupled in circuit with said microwave generator for actuating same, said switch being mounted in said cabinet;

a sliding member mounted between said hook and said switch in the closed position of said door and slidably movable by said cooking start button; and means for biasing said hook to contact said sliding member so as to bias same to actuate said switch to turn on said microwave generator, said sliding member automatically deactuating said switch to turn off said microwave generator when said hook begins to move to the opened position of said door.

2. A microwave heating apparatus according to claim 1, wherein said locking mechanism further comprises:

a guide member formed adjacent the upper side of said holding member for guiding said sliding member up and down; and a stopper formed near said locking member for preventing said sliding member from moving by said hook before said cooking start button is operated.

3. A microwave heating apparatus according to claim 2, wherein said guide member has a pair of inclined slits for guiding said sliding member.

4. A microwave heating apparatus according to claim 3, wherein a part of said sliding member is disposed between said stopper and an end of said locking member in the opened position.

5. A microwave heating apparatus according to claim 3, wherein said sliding member further comprises:

a pair of tabs for inserting in said inclined slits for securing said sliding member;

a base portion for contacting with said hook and an actuator of said switch to turn on said switch, a part of said base portion contacting said stopper in the closed position of said door and before said cooking start button is operated; and a standing portion movable by said cooking start button to turn on said switch.

6. A microwave heating apparatus according to claim 4, wherein said sliding member further comprises:

a pair of tabs for inserting in said inclined slits for securing said sliding member;

a base portion for contacting with said hook and an actuator of said switch to turn on said switch, a part of said base portion contacting said stopper in the closed position of said door and before said cooking start button is operated; and a standing portion movable by said cooking start button to turn on said switch.

* * * * *